US010443300B2

(12) United States Patent
Kuster et al.

(10) Patent No.: US 10,443,300 B2
(45) Date of Patent: Oct. 15, 2019

(54) INSULATING GLASS UNIT FOR A REFRIGERATION UNIT

(71) Applicant: SAINT-GOBAIN GLASS FRANCE, Courbevoie (FR)

(72) Inventors: Hans-Werner Kuster, Aachen (DE); Edouard Jonville, Courbevoie (FR); Walter Schreiber, Aachen (DE); Egbert Schwerdt, Berg (CH)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 15/777,899

(22) PCT Filed: Mar. 20, 2017

(86) PCT No.: PCT/EP2017/056477
§ 371 (c)(1),
(2) Date: May 21, 2018

(87) PCT Pub. No.: WO2017/174333
PCT Pub. Date: Oct. 12, 2017

(65) Prior Publication Data

US 2018/0340365 A1 Nov. 29, 2018

(30) Foreign Application Priority Data

Apr. 5, 2016 (EP) ..... 16163776

(51) Int. Cl.
*E06B 3/663* (2006.01)
*A47F 3/00* (2006.01)
(Continued)

(52) U.S. Cl.
CPC ..... *E06B 3/66319* (2013.01); *A47F 3/005* (2013.01); *A47F 3/043* (2013.01);
(Continued)

(58) Field of Classification Search
CPC ..... E06B 3/66319; E06B 3/66342; E06B 3/66304; E06B 3/66333; E06B 3/67326;
(Continued)

(56) References Cited

U.S. PATENT DOCUMENTS 2,276,112 A 3/1942 Stoneback
2,756,467 A 7/1956 Oliver
(Continued)

FOREIGN PATENT DOCUMENTS

CH 687937 A5 3/1997
DE 3403133 A1 8/1985
(Continued)

OTHER PUBLICATIONS

International Search Report for International Application No. PCT/EP2017/056477 filed Mar. 20, 2017 on behalf of Saint-Gobain Glass France, dated Jun. 19, 2017. 5 pages. (German + English Translation).
(Continued)

*Primary Examiner* — Joshua K Ihezie
(74) *Attorney, Agent, or Firm* — Steinfl + Bruno, LLP

(57) ABSTRACT

An insulating glass unit suitable for a refrigeration unit is presented. The insulating glass unit includes a first pane, a second pane spaced at a distance from the first pane, a peripheral spacer frame between the first pane and the second pane, and an inner interpane space. According to one aspect, the spacer frame includes four hollow-profile polymeric spacers, which are secured between the first pane and the second pane along one of the four sides of the insulating glass. According to another aspect, the two first hollow-profile polymeric spacers are arranged along two opposing first sides of the insulating glass unit and the two second hollow-profile polymeric spacers are arranged along two opposing second sides of the insulating glass unit. Accord-
(Continued)

Figure 1:
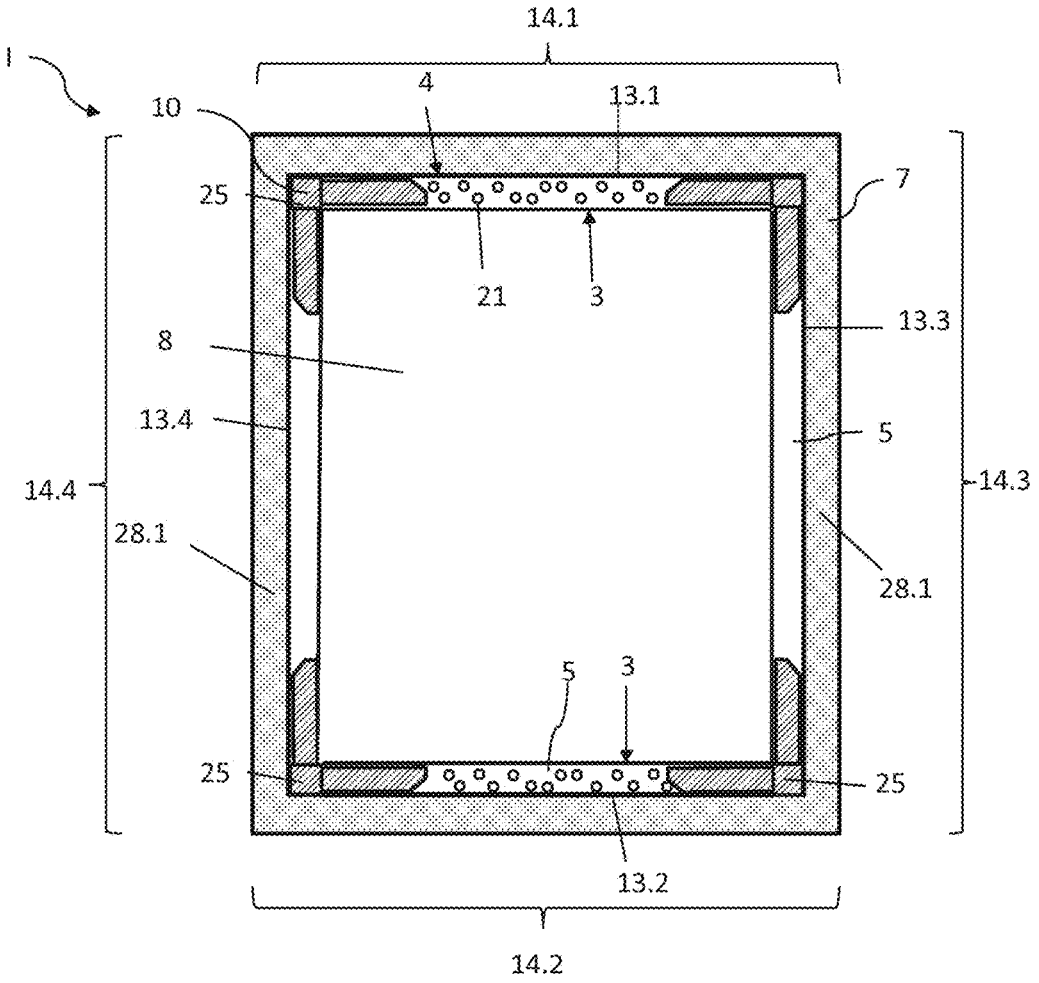

ing to yet another aspect, the first polymeric hollow-profile spacers contain 5% to 50% and the second polymeric hollow-profile spacers contain 0% to 0.5% reinforcement fibers.

10 Claims, 5 Drawing Sheets

(51) Int. Cl.
*A47F 3/04* (2006.01)
*E06B 3/02* (2006.01)
*E06B 3/673* (2006.01)

(52) U.S. Cl.
CPC ..... *A47F 3/0434* (2013.01); *E06B 3/025* (2013.01); *E06B 3/66304* (2013.01); *E06B 3/66333* (2013.01); *E06B 3/66342* (2013.01); *E06B 3/67326* (2013.01); *E06B 2003/6638* (2013.01); *E06B 2003/66338* (2013.01)

(58) Field of Classification Search
CPC ..... E06B 3/025; E06B 2003/66338; E06B 2003/6638; A47F 3/005; A47F 3/043; A47F 3/0434
See application file for complete search history.

(56) References Cited

U.S. PATENT DOCUMENTS 3,918,202 A 11/1975 Smith
4,332,663 A 6/1982 Berneke
4,450,660 A 5/1984 Dean
4,453,855 A 6/1984 Richter et al.
4,551,364 A 11/1985 Davies
4,576,841 A 3/1986 Lingemann
4,604,840 A 8/1986 Mondon
4,651,482 A 3/1987 Borys
4,658,553 A * 4/1987 Shinagawa ..... A47F 3/0434 428/34
4,817,354 A 4/1989 Bayer
4,887,402 A 12/1989 Da Col
4,994,309 A * 2/1991 Reichert ..... E06B 3/66319 156/109
5,154,531 A 10/1992 Peterson
5,313,762 A * 5/1994 Guillemet ..... B29C 47/0023 52/717.02
6,029,411 A 2/2000 Richardson
6,209,269 B1 4/2001 Valderrama
6,247,948 B1 6/2001 Davis et al.
6,537,629 B1 3/2003 Ensinger
6,868,648 B2 3/2005 Glover et al.
6,974,518 B2 12/2005 Hornung et al.
8,240,940 B2 8/2012 Strohheker
8,683,764 B2 4/2014 Smith et al.
9,498,072 B2 11/2016 Artwohl et al.
2002/0056184 A1* 5/2002 Richardson ..... A47F 3/0434 29/458
2005/0003116 A1 1/2005 Demars et al.
2007/0218224 A1 9/2007 Farbstein
2007/0261795 A1* 11/2007 Rosskamp ..... E06B 3/30 156/556
2008/0263973 A1* 10/2008 Lenhardt ..... E06B 3/667 52/204.591
2009/0129857 A1 5/2009 Strohheker
2009/0211188 A1 8/2009 Defoort et al.
2014/0265758 A1 9/2014 Reichert
2014/0311065 A1* 10/2014 Schreiber ..... E06B 3/66319 52/204.593
2015/0107167 A1* 4/2015 Baumann ..... E06B 3/66319 52/172
2015/0245720 A1* 9/2015 Isfort ..... A47F 3/0434 312/116
2016/0120336 A1* 5/2016 Schneider ..... A47F 3/0434 312/116
2016/0201381 A1* 7/2016 Kuster ..... E06B 3/66319 52/172
2016/0290032 A1* 10/2016 Kuster ..... E06B 3/66319
2016/0290033 A1* 10/2016 Messere ..... E06B 3/66352
2017/0298680 A1* 10/2017 Schreiber ..... E06B 3/66319
2018/0195338 A1* 7/2018 Frank ..... E06B 3/667
2018/0195339 A1 7/2018 Kuster et al.
2018/0252021 A1* 9/2018 Frank ..... E06B 3/66314
2018/0298674 A1* 10/2018 Runze ..... E06B 3/66319
2018/0344053 A1* 12/2018 Schreiber ..... A47F 3/0434

FOREIGN PATENT DOCUMENTS

DE 102005002285 A1 7/2006
DE 602 24 695 T2 1/2009
DE 102012106200 A1 1/2014
DE 112014002800 T5 3/2016
EP 0086345 A1 8/1983
EP 2007961 A1 12/2008
EP 2930296 A1 10/2015
JP H03021423 Y 5/1991
JP 2002504639 A 2/2002
JP 2015509900 A 4/2015
JP 2015187333 A 10/2015
WO 01/65047 A1 9/2001
WO 2006/123935 A1 11/2006
WO 2007/118611 A1 10/2007
WO 2013/104507 A1 7/2013
WO 2014/009244 A1 1/2014
WO 2014/131094 A1 9/2014
WO 2014/152730 A1 9/2014
WO 2014/198549 A1 12/2014
WO 2017/064166 A1 4/2017
WO 2017/108870 A1 6/2017
WO 2017/174333 A1 10/2017

OTHER PUBLICATIONS

International Search Report for International Application No. PCT/EP2016/074546 filed Oct. 13, 2016 on behalf of Saint-Gobain Glass France, dated Nov. 4, 2016. 5 pages. (German + English Translation).
Written Opinion for International Application No. PCT/US2016/074546 filed Oct. 13, 2016 on behalf of Saint-Gobain Glass France, dated Nov. 4, 2016. 11 pages.
International Search Report for International Application No. PCT/EP2016/082042 filed Dec. 20, 2016 on behalf of Saint-Gobain Glass France, dated Apr. 26, 2017. 5 pages. (German original + English translation).
Non-Final Office Action for U.S. Appl. No. 15/740,344, filed Mar. 30, 2018 on behalf of Saint-Gobain Glass France, dated Oct. 2, 2018. 22 pgs.
Written Opinion for International Application No. PCT/EP2016/082042 filed Dec. 20, 2016 on behalf of Saint-Gobain Glass France, dated Apr. 26, 2017. 9 pages. (English Translation + German Original).
Written Opinion for International Application No. PCT/EP2017/056477 filed Mar. 20, 2017 on behalf of Saint-Gobain Glass France, dated Jun. 19, 2017. 14 pages. (English Translation + German Original).
International Preliminary Report on Patentability for International Application No. PCT/EP2016/074546 filed on Oct. 13, 2016 on behalf of Saint-Gobain Glass France dated Apr. 17, 2018 13 pages (English + Original).
International Preliminary Report on Patentability for International Application No. PCT/EP2016/082042 filed on Dec. 20, 2016 on behalf of Saint-Gobain Glass France dated Jun. 26, 2018 11 pages. (English + Original).
International Preliminary Report on Patentability for International Application No. PCT/EP2017/056477 filed on Mar. 20, 2017 on behalf of Saint-Goban Glass France dated Oct. 9, 2018 15 pages (English + Original).

(56) References Cited

OTHER PUBLICATIONS

Final Office Action for U.S. Appl. No. 15/740,344, filed Mar. 30, 2018, on behalf of Saint-Gobain Glass France, dated Feb. 19, 2019, 21 pages.
Japanese Notice of Reasons for Rejection for Japanese Application No. 2018-532053 dated Jun. 4, 2019 (English Translation Only).

* cited by examiner

INSULATING GLASS UNIT FOR A REFRIGERATION UNIT

CROSS REFERENCE TO RELATED APPLICATIONS

The present application is the U.S. National Stage of International Patent Application No. PCT/EP2017/056477 filed on Mar. 20, 2017, which, in turn, claims priority to European Patent Application No. 16163776.4 filed on Apr. 5, 2016.

The invention relates to an insulating glass unit for a refrigeration unit, a door for a refrigeration unit, a method for producing such an insulating glass unit, and use thereof.

Refrigerator display cases or refrigerators with transparent doors are widely used to display and present refrigerated goods for customers. The goods are kept in the refrigerator display case at temperatures below 10° C. and thus protected against rapid spoiling. In order to keep the thermal loss as low as possible, insulating glass units are frequently used as doors. Transparent doors enable viewing of goods without having to open the refrigerator or display case. Each opening of the doors results in an increase of the temperature in the refrigerator display case and thus exposes the goods to the risk of warming up. Consequently, it is desirable to present the goods in such a manner that the number of opening operations is minimized. To that end, it is important that the view through the closed doors be restricted as little as possible. In prior art insulating glass units, the view is impeded at least in the edge region by elements of the nontransparent peripheral doorframe. In prior art insulating glass units, the doorframe conceals the likewise nontransparent peripheral edge seal. The edge seal of an insulating glass unit usually comprises at least a peripheral spacer, a hygroscopic desiccant as well as a primary sealant for securing the spacer between the panes and a secondary sealant, which stabilizes and further seals the edge seal. These components are usually not transparent, in other words, in the region of the peripheral edge seal, the view is restricted.

Various approaches are known for solving this problem. Known from DE 10 2012 106 200 A1 is a refrigerator that has two insulating glass units as doors, which include a transparent spacer element on at least one vertical side and have no frame element on this side. The spacer element is implemented as a T-shaped cross-sectional profile, which simultaneously serves a supporting and sealing function. The spacer element is implemented as a one-piece, solid profile that is produced by extrusion.

Another approach is described in WO2014/198549 A1. Here, transparent spacer elements that are arranged between the panes at least on one vertical side are also used. The transparent spacer elements are, in particular, fixed between the panes with adhesive strips. Spacers made of transparent plastic resins which can be used in combination with metallic spacers along the horizontal sides are also disclosed. The combination of such different materials is problematic in insulating glass units. In the long run, different coefficients of expansion of the materials used can result in leaks of the edge seal. In addition, the sealant must be coordinated with the materials of the spacers. With the use of multiple sealant types, material incompatibilities between the sealant can easily occur, which, in turn, trigger leaks of the edge seal.

Known from the international patent application WO 2013/104507 A1 is a spacer for a multipane insulating glazing, which comprises a composite made up of a glass-fiber-reinforced polymeric main body, two parallel pane contact surfaces, an adhesive surface, and a glazing interior surface, as well as an insulation film. The pane contact surfaces and the adhesive surface are connected to one another directly or via connecting surfaces. Through the selection of the glass fiber content in the main body, the coefficient of thermal expansion of the main body can be varied and adapted. By adapting the coefficients of thermal expansion of the main body and of the polymeric insulation film, temperature-induced stresses between the different materials and chipping of the insulation film can be avoided. The main body preferably has a glass fiber content of 20% to 50%, particularly preferably of 30% to 40%. The glass fiber content in the main body simultaneously improves strength and stability; however, the production of transparent spacers or of spacers with colored patterns is disrupted due to the presence of the reinforcement fibers.

From the German patent DE 11 2014002 800 T5, a glazed element that includes an insulating glazing is known. The insulating glazing includes at least one first and one second glass pane that are connected using a spacer. The spacer is formed by a transparent resin that is selected from among polymethylmethacrylate, polycarbonate, polystyrene, polyvinyl chloride, acrylonitrile butadiene styrene, nylon, or a mixture of these compounds. Such a spacer offers the advantage that it counters the possible exchange of gas, moisture, and dust between the surrounding regions and the gas filling of the glazing and is, at the same time, transparent, as a result of which it is possible to see the products contained in the cabinet having a refrigerated chamber without the view of the consumer being obscured by the presence of a frame, or in particular, of lateral cross pieces. It is also mentioned, incidentally, that in the prior art the spacers are generally a hollow, extruded, or molded profile made of metal or of an organic material or even a profile with connection angles or a profile bent at the corners. Reference to the polymers mentioned is not made.

The object of the present invention is to provide an improved insulating glass unit for a refrigeration unit, to provide a door for a refrigeration unit, and also to provide a simplified method for producing an insulating glass unit. Specifically, the object of the present invention was to provide an insulating glass unit for a refrigeration unit, which, on the one hand, has particularly high stability and compressive strength of the spacers and, on the other, greatly increases the design possibilities of the spacers.

The object of the present invention is accomplished by an insulating glass unit in accordance with the present disclosure. Preferred embodiments are also disclosed.

The insulating glass unit for a refrigeration unit according to the invention comprises at least one first pane, a second pane spaced at a distance from the first pane, and a peripheral spacer frame between the first pane and the second pane. An inner interpane space is delimited by the spacer frame, the first pane, and the second pane. The inner interpane space is enclosed by the spacer frame. The insulating glass unit has four sides. The sides of the insulating glass unit are the sides along which the edge region of the insulating glass unit is situated. The two first sides are opposite one another and the two second sides are opposite one another. The spacer frame comprises at least four polymeric hollow-profile spacers. Each hollow-profile polymeric spacer is secured along one of the four sides of the insulating glass unit. The polymeric hollow-profile spacers are in each case secured along the four sides between the first pane and the second pane via a primary sealant. Two first hollow-profile polymeric spacers are arranged along the two opposing first sides and two second hollow-profile polymeric spacers are arranged along the two second sides of the insulating glass unit. The first polymeric hollow-profile spacers include 5% to 50% reinforcement fibers. The reinforcement fibers result in increased stability of the polymeric hollow-profile spacers and thus in a longer service life of the insulating glass unit. At the same time, the polymeric hollow-profile spacers have, compared to metallic hollow-profile spacers, advantageously low thermal conductivities. The second polymeric hollow-profile spacers include 0% to 0.5% reinforcement fibers, as a result of which the design possibilities are particularly diverse. The fact that no or virtually no reinforcement fibers are included enables, for example, the production of transparent spacers or of spacers with colored patterns, which would otherwise be disrupted by the presence of reinforcement fibers. Due to the lack of reinforcement, the second polymeric hollow-profile spacers have lower compressive strength. However, surprisingly, the insulating glass unit according to the invention with first and second polymeric hollow-profile spacers has excellent stability. The arrangement according to the invention along opposing sides of the insulating glass unit results in a highly stable insulating glass unit, which is comparable to insulating glass units, which have reinforced spacers along all four sides. In comparison with insulating glass units with both metallic and polymeric spacers, the insulating glass unit according to the invention has the advantage that the edge seal has lower thermal conductivity. Also, because of the different coefficients of thermal expansion of the metallic and polymeric spacers, there is an increased buildup of tension in the spacer frame that can result in a premature detachment of the sealant in the edge region. Thus, the invention provides a stable insulating glass unit that has a polymeric spacer profile along all four sides and thus has excellent thermal insulation properties.

In a preferred embodiment of the insulating glass unit according to the invention, the second polymeric hollow-profile spacers are implemented transparent. This has the advantage that no barrier to vision is present along two opposing sides such that the through-vision area is maximized. Since, according to the invention, the second polymeric hollow-profile spacers contain virtually no reinforcement fibers, they can be designed transparently translucent. In prior art insulating glass units, reinforcement fibers are, as a rule, provided all the way around for hollow-profile polymeric spacers. Consequently, to date, no insulating glass units with transparent hollow-profile spacers have been used. The insulating glass unit according to the invention is surprisingly stable, even without the stabilizing effect of reinforcement fibers along all four sides, such that the transparent embodiment is possible.

In the context of the invention, "transparent" means that the material can be seen through. An observer can recognize items arranged behind the layer of material. The material is, accordingly, light permeable and preferably has light transmittance in the visible spectrum of at least 30%, particularly preferably of at least 50%.

In the context of the invention, "reinforcement fibers" designate fibers that are added to the polymeric main body of the hollow-profile for reinforcement of the profile. These fibers are preferably glass fibers, natural fibers, or ceramic fibers. These fibers increase the stiffness and the strength of the profile. Preferably used are fibers in the form of short fibers with lengths between 0.05 mm and 0.5 mm. These lengths can be processed particularly well in an extruder such that the reinforcement fibers can be incorporated directly during extrusion. The percentage data are weight percentages of reinforcement fibers based on the content of reinforcement fibers in the polymeric main body, in other words, possible barrier films or coatings are not taken into account.

In a preferred embodiment of the insulating glass unit according to the invention, the polymeric hollow-profile spacers comprise at least one polymeric main body at least comprising a first side wall, a second side wall arranged parallel thereto, a glazing interior wall, an outer wall, and a cavity. The cavity is enclosed by the side walls, the glazing interior wall, and the outer wall. The glazing interior wall is arranged perpendicular to the side walls and connects the first side wall to the second side wall. The side walls are the walls of the polymeric hollow-profile spacer, on which the outer panes of the insulating glass unit are mounted. The first side wall and the second side wall run parallel to one another. The glazing interior wall is the wall of the polymeric hollow-profile spacer that points toward the inner interpane space in the finished insulating glass unit. The outer wall is arranged substantially parallel to the glazing interior wall and connects the first side wall to the second side wall. The outer wall points toward the outer interpane space. The cavity of the polymeric main body results in a weight reduction in comparison with a solidly molded spacer and can be completely or partially filled with a desiccant.

Preferably, at least one of the two first polymeric hollow-profile spacers contains a desiccant and the cavity of the two second polymeric hollow-profile spacers is free of desiccant. The desiccant binds moisture that is present in the inner interpane space and thus prevents fogging of the insulating glass unit from the inside. The second polymeric hollow-profile spacers need not be filled with desiccant, since installation in at least one of the hollow-profile spacers is sufficient to prevent fogging of the panes. Thus, on the one hand, material can be saved and, on the other, this approach also has optical advantages.

The desiccant preferably contains silicon gels, molecular sieve, $CaCl_2$, $Na_2SO_4$, activated carbon, silicates, bentonites, zeolites, and/or mixtures thereof.

The outer wall of the polymeric main body is the wall which is opposite the glazing interior wall and which faces away from the inner interpane space in the direction of the outer interpane space. The outer wall preferably runs perpendicular to the side walls. However, the sections of the outer wall nearest the side walls can, alternatively, be inclined at an angle of preferably 30° to 60° relative to the outer wall in the direction of the side walls. This angled geometry improves the stability of the polymeric hollow-profile spacer and enables better bonding of the main body with a barrier film. A planar outer wall, which remains perpendicular to the side walls (parallel to the glazing interior wall) in its entire course has, in contrast, the advantage that the sealing surface between a polymeric hollow-profile spacer and the side walls is maximized and a simpler shape facilitates the production process.

Preferably, the polymeric main body of the polymeric hollow-profile spacer is made of polymers since these have low thermal conductivity, which results in improved thermal insulation properties of the edge seal. Particularly preferably, the polymeric main body contains biocomposites, polyethylene (PE), polycarbonates (PC), polypropylene (PP), polystyrene, polybutadiene, polynitriles, polyesters, polyurethanes, polymethylmethacrylates, polyacrylates, polyamides, polyethylene terephthalate (PET), polybutylene terephthalate (PBT), polyvinyl chloride (PVC), particularly preferably acrylonitrile butadiene styrene (ABS), acrylonitrile styrene acrylester (ASA), acrylonitrile butadiene styrene/polycarbonate (ABS/PC), styrene acrylonitrile (SAN), PET/PC, PBT/PC, and/or copolymers or mixtures thereof.

In a preferred embodiment of the insulating glass unit according to the invention, the first polymeric hollow-profile spacers contain, as reinforcement fibers, 15% to 40 glass fibers, based on the polymeric main body. Particularly preferably, the first polymeric hollow-profile spacers contain 20% to 35% glass fibers. In this range, particularly good stabilization of the polymeric hollow-profile spacers is obtained with glass fibers; and, at the same time, low thermal conductivity of the hollow-profile spacer is achieved. Through the selection of the glass fiber content in the hollow-profile, the coefficient of thermal expansion of the hollow-profile can be varied and adapted. Thus, tensions between the different materials of the first and second polymeric hollow-profile spacers can be avoided. Glass fibers can be processed particularly well and, in particular, can be coextruded well along with the material of the polymeric main body.

The hollow-profile polymeric spacer preferably has, along the glazing interior wall, a width of 5 mm to 45 mm, preferably of 10 mm to 24 mm. In the context of the invention, the "width" is the dimension extending between the side walls. The width is the distance between the surfaces of the two side walls facing away from one another. The distance between the panes of the insulating glass unit is determined by the selection of the width of the glazing interior wall. The exact dimensions of the glazing interior wall are governed by the dimensions of the insulating glass unit and the desired size of the interpane space.

The hollow-profile polymeric spacer preferably has, along the side walls, a height $h_G$ of 5 mm to 15 mm, particularly preferably of 6 mm to 10 mm. In this range for the height, the hollow-profile spacer has advantageous stability, but is, on the other hand, advantageously inconspicuous in the insulating glass unit. Also, the cavity of the hollow-profile spacer has an advantageous size for the possible accommodation of a suitable amount of desiccant. The total height $h_G$ is the distance between the surfaces of the outer wall and the glazing interior wall facing away from one another.

The wall thickness d of the polymeric hollow-profile spacer is 0.5 mm to 15 mm, preferably 0.5 mm to 10 mm, particularly preferably 0.7 mm to 1.2 mm.

In a preferred embodiment of the insulating glass unit according to the invention, the compressive strength of the second polymeric hollow-profile spacers is lower by 20% to 40% than that of the first polymeric hollow-profile spacers. With this difference in compressive strength, particularly stable insulating glass units are obtained and, at the same time, flexibility in the design of the polymeric hollow-profile spacers is increased.

The compressive strength of a polymeric hollow-profile spacer means, in the context of the invention, the compressive strength in transverse direction of the hollow-profile spacer. The transverse direction is perpendicular to the extension direction of the hollow profile in the plane of the glazing interior surface of the hollow-profile spacer. The distance between the first pane and the second pane is determined by the width b of the hollow-profile spacer in the transverse direction. The compressive strength describes the stability of a spacer on which pressure is exerted by the first and second pane in an insulating glass unit. The compressive strength is indicated in force/length [N/cm]. The length L is measured in the extension direction of the hollow-profile spacer and indicates how long the part of the hollow-profile spacer on which the force acts laterally is. An exemplary measurement is described along with the example.

In the case of a polymeric hollow-profile spacer with a width b of 12 mm-20 mm, a wall thickness d of 1 mm, and a total height $h_G$ of 5 mm-8 mm, the first polymeric hollow-profile spacers preferably have a compressive strength of 350 N/cm to 450 N/cm. The compressive strength of the second polymeric hollow-profile spacers is preferably 50 N/cm to 150 N/cm less than that of the first polymeric hollow-profile spacers, particularly preferably 100 N/cm less. In these ranges, a particularly stable insulating glass unit is obtained.

In a preferred embodiment of the insulating glass unit according to the invention, the first polymeric hollow-profile spacers and the second polymeric hollow-profile spacers are secured on the first pane and the second pane via a transparent primary sealant. The polymeric hollow-profile spacers are arranged such that an outer interpane space, delimited by the outer wall of the hollow-profile spacer facing the surroundings, is created between the first pane and the second pane. Accordingly, the panes protrude somewhat beyond the hollow-profile spacers such that the outer interpane space is created. The outer interpane space is filled with a transparent secondary sealant. The outer interpane space of the insulating glass unit is delimited by the two panes and the outer wall of the hollow-profile spacer. The secondary sealant serves to stabilize the edge seal of the insulating glass unit and absorbs the mechanical forces acting on the edge seal. The primary sealant serves to secure the panes and to seal the inner interpane space against the penetration of moisture and the loss of a gas filling that is possibly present. The securing of all polymeric hollow-profile spacers via a transparent sealant has the advantage that material incompatibilities between different sealants can be avoided. The use of a transparent sealant has, above all, optical advantages. In particular, in combination with hollow-profile spacers visually appealing in design, a transparent sealant provides a view of the main body. In combination with second polymeric hollow-profile spacers implemented transparently, a transparent sealant has the advantage that the through-vision region along the opposing second sides of the insulating glazing unit is maximized.

In an alternative preferred embodiment, the primary and secondary sealant are not transparent. These sealants are available economically but do have optical disadvantages.

Preferably, the secondary sealant contains polymers or silane-modified polymers, particularly preferably organic polysulfides, silicones, room-temperature vulcanizing (RTV) silicone rubber, peroxide-vulcanizing silicone rubber, and/or addition-vulcanizing silicone rubber, polyurethanes, and/or butyl rubber. These sealants have a particularly good stabilizing effect. These sealants are in each case available in a transparent and an opaque variant.

The primary sealant preferably contains a polyisobutylene. The polyisobutylene can be a cross-linking or a non-cross-linking polyisobutylene. Polyisobutylenes are available in a transparent and an opaque form.

The first and second polymeric hollow-profile spacers of the insulating glass unit according to the invention have, in comparison to metallic hollow-profile spacers, the advantage that they have lower thermal conductivity. In contrast, high thermal conductivity results in the formation of a thermal bridge in the region of the edge seal, which can result, with large temperature differences between a cooled interior and the ambient temperature, in the accumulation of water condensation on the glass pane facing the outside surroundings. This, in turn, results in obstruction of the view of goods placed, for example, in a refrigerator display case. This problem can be avoided by using polymeric hollow-profile spacers with low thermal conductivity. However, the polymeric materials often have inferior properties in terms of gas- and vapor-tightness. Consequently, in a preferred embodiment of the insulating glass unit according to the invention, the first and second polymeric hollow-profile spacers have, at least on their outer wall, a gas- and water vapor-tight barrier. In a preferred embodiment, a gas- and vapor-tight barrier is installed on the outer wall and on a portion of the side walls of the polymeric hollow-profile spacers. Installation on a portion of the side walls significantly improves the leakproofness of the polymeric hollow-profile spacer. The barrier increases the gas diffusion resistance and moisture diffusion resistance of the polymeric hollow-profile spacer and thus improves the sealing of the insulating glass unit according to the invention against the loss of a gas filling that is possibly present and against the penetration of moisture into the inner interpane space. Suitable barriers are known from the prior art. Considered, in particular, are metallic foils and polymeric films with metallic coatings, as disclosed, for instance, in WO2013/104507.

In a preferred embodiment of the insulating glass unit according to the invention, the two second polymeric hollow-profile spacers include in each case, on their outer wall, a gas- and vapor-tight transparent barrier in the form of a transparent barrier film or a transparent barrier coating. The barriers known from the prior art are usually not transparent. The transparent barrier has, in particular, optical advantages. The transparent barrier enables viewing the polymeric hollow-profile spacer, which is particularly advantageous with a hollow-profile spacer having a pattern or, in particular, with a transparent hollow-profile spacer. In this case, the view through the transparent hollow-profile spacer is not impaired by a nontransparent barrier.

In a preferred embodiment of the insulating glass unit according to the invention, the transparent barrier is implemented as a transparent barrier film. The transparent barrier film is preferably a multilayer film that includes at least one polymeric layer and one ceramic layer. Transparent polymeric layers are available economically. The ceramic layer can be applied as a transparent layer and contributes to the necessary gas diffusion resistance and moisture diffusion resistance of the hollow-profile spacer. Thus, the structure comprising a polymeric layer and a ceramic layer enables the production of a transparent barrier film.

In another preferred embodiment, the transparent barrier film includes at least one polymeric layer and at least two ceramic layers, which are arranged alternatingly with the at least one polymeric layer. The alternating arrangement of a plurality of ceramic layers with at least one polymeric layer advantageously provides for a particularly long-lasting improvement of tightness, since defects in one of the ceramic layers are compensated by the other layer or layers. The adhesion of a plurality of thin layers one atop the other is also easier to realize than the adhesion of a few thick layers.

Particularly preferably, the transparent barrier film includes at least two polymeric layers, which are arranged alternatingly with at least two ceramic layers. In this case, at least one of the ceramic layers is protected by two polymeric layers against damage from external mechanical influences.

Particularly preferably, the transparent barrier film includes just as many polymeric layers as ceramic layers. Such a barrier film can be produced particularly easily by gluing or laminating of individual polymeric layers that are provided with a ceramic layer.

In another preferred embodiment, the barrier film is mounted on the hollow-profile spacer such that a ceramic layer faces in the direction of the external environment. In this case, the ceramic layer acts, in the finished insulating glass unit, as an adhesion promoter for the secondary sealant.

The ceramic layers preferably contain silicon oxides ($SiO_x$) and/or silicon nitrides. The ceramic layers preferably have a thickness of 20 nm to 200 nm. Layers of this thickness improved the gas diffusion resistance and moisture diffusion resistance while retaining the desired transparent optical properties.

The ceramic layers are preferably deposited on a polymeric layer in a thin-film vacuum method known to the person skilled in the art. This technique enables the selective deposition of defined ceramic layers without the use of additional adhesive layers.

Other polymeric layers are preferably bonded to the other layers of the transparent barrier film via adhesion-promoting adhesive layers. Considered, for example, as adhesion promoting adhesive layers are polyurethane-based transparent adhesive layers.

In another preferred embodiment, the transparent barrier film includes at least one polymeric layer and at least one transparent metallic layer. Transparent metallic layers improve the gas diffusion resistance and the moisture diffusion resistance of the hollow-profile spacer.

In another preferred embodiment, the transparent barrier film includes at least two transparent metallic layers that are arranged alternatingly with at least one polymeric layer. Transparent metallic layers improve the tightness of the transparent barrier film and can be produced economically in large quantities. Preferably, at least two transparent metallic layers are arranged alternatingly with at least two polymeric layers. Thus, particularly good results are achieved.

The transparent metallic layers preferably contain aluminum, silver, magnesium, indium, tin, copper, gold, chromium, and/or alloys or oxides thereof. Particularly preferably, the transparent metallic layers contain indium tin oxide (ITO), aluminum oxide ($Al_2O_3$), and/or magnesium oxide. The metallic layers are preferably applied in a thin-film vacuum method and have in each case a thickness of 20 nm to 100 nm, particularly preferably 50 nm to 80 nm. In these thickness ranges, the layers can be implemented transparent and are, at the same time, thick enough to improve the leakproofness of the hollow-profile spacer.

The polymeric layers of the transparent barrier film preferably comprise polyethylene terephthalate, ethylene vinyl alcohol, polyvinylidene chloride, polyamides, polyethylene, polypropylene, silicones, acrylonitriles, polyacrylates, polymethylacrylates, and/or copolymers or mixtures thereof.

A polymeric layer is preferably implemented as a single-layer film. This is advantageously economical. In an alternative preferred embodiment, the polymeric layer is implemented as a multilayer film. In this case, a plurality of layers made of the materials listed above are bonded to one another. This is advantageous because the material properties can be perfectly coordinated with the sealants, adhesives, or adjacent layers used.

The polymeric layers preferably have, in each case, a layer thickness of 5 μm to 80 μm.

The transparent barrier film preferably has gas permeation of less than 0.001 g/($m^2$ h).

In an alternative preferred embodiment, the gas- and vapor-tight transparent barrier is implemented as a barrier coating. This transparent barrier coating contains aluminum, aluminum oxides, and/or silicon oxides and is preferably applied using a PVD method (physical vapor deposition). The transparent barrier coating containing aluminum, aluminum oxides, and/or silicon oxides delivers particularly good results in terms of tightness and also displays excellent adhesion properties to the secondary sealants used in the insulating glass unit. Application by a vacuum coating method enables deposition of particularly thin and transparent layers.

In a preferred embodiment of the insulating glass unit according to the invention, the glazing interior wall of at least one of the polymeric hollow-profile spacers has at least one opening. Preferably, a plurality of openings are made in the glazing interior wall of a hollow-profile spacer. The total number of openings openings depends on the size of the insulating glass unit. Preferably, the polymeric hollow-profile spacers in whose cavity a desiccant is introduced include openings. The openings connect the cavity to the inner interpane space, making a gas exchange between them possible. Thus, absorption of humidity by a desiccant situated in the cavity is enabled and thus fogging of the panes is prevented. The openings are preferably implemented as slits, particularly preferably preferably as slits with a width of 0.2 mm and a length of 2 mm.

The slits ensure optimum air exchange without the desiccant being able to penetrate out of the hollow chamber into the interpane space.

The first pane and the second pane of the insulating glass unit preferably contain glass and/or polymers, particularly preferably quartz glass, borosilicate glass, soda lime glass, polymethylmethacrylate, polycarbonate, and/or mixtures thereof.

The first pane and the second pane have a thickness of 2 mm to 50 mm, preferably 3 mm to 16 mm, with the two panes also possibly having different thicknesses.

The insulating glass unit according to the invention is preferably filled with an inert gas, particularly preferably with a noble gas, preferably, argon or krypton, which reduce the heat transfer value in the inner interpane space.

In another preferred embodiment, the insulating glass unit includes more than two panes. In that case, the hollow-profile spacers can, for example, include grooves in which at least one additional pane is arranged. Multiple panes can also be implemented as a composite glass pane.

The invention further relates to a door for a refrigeration unit at least comprising an insulating glass unit according to the invention and two horizontal frame elements. The horizontal frame elements are arranged along the first sides of the insulating glass unit. The horizontal frame elements are arranged such that they obscure the view of the first polymeric hollow-profile spacers. The horizontal frame elements are, accordingly, not implemented transparent, in other words, they block the view of the edge seal with the first polymeric hollow-profile spacers and sealants. Thus, they improve the visual appearance of the door. The horizontal frame elements wrap around the first pane and the second pane in the edge region. Thus, the horizontal frame elements stabilize the door and also offer the capability, of mounting additional securing means, for example, for the suspension of the panes. The second polymeric hollow-profile spacers are implemented transparent and secured between the first pane and the second pane via a transparent primary sealant. A transparent secondary sealant is arranged along the second sides of the insulating glass unit. The second polymeric hollow-profile spacers are arranged along the vertical sides of the door. Thus, along the vertical sides, the view of the goods presented in the refrigeration unit is not blocked. In particular, through the combination of transparent primary and secondary sealants, the visual appearance of the transparent second hollow-profile spacer is surprisingly improved.

With installation of the door in a showcase or a refrigerator display case, the "horizontal sides" are the upper and lower side of the door. The "vertical sides" are, in this case, the right and left side. With installation of the door in, for example, a freezer display case, in horizontal orientation, the vertical sides, as viewed by the observer, are likewise the right and left side and the horizontal sides are the rear and front side.

For opening the door of the refrigeration unit, a door handle is preferably arranged on the first pane. The first pane is the pane, which, after installation of the door in the refrigeration unit, faces the external surroundings, i.e., faces in the direction of a customer. Despite the use of the second polymeric hollow-profile spacer without additional reinforcement fibers along the second sides of the insulating glass unit, the stability is surprisingly high enough that, with the use of a door handle on the surface of the first pane, the insulating glass unit is durably stable. The door handle is preferably glued. Visually, this is particularly advantageous.

In another preferred embodiment of the door for a refrigeration unit according to the invention, an additional vertical frame element that is the mounted along one of the second sides and wraps around the edges of the first pane and the second pane at least in subregions is installed. Thus, optimum stabilization of the door is achieved and additional elements such as for door suspension can be secured on the vertical frame element. The vertical frame element is installed in the refrigeration unit on the side of the insulating glass unit opposite the door opening.

The frame element preferably comprises a metal sheet, particularly preferably an aluminum or stainless steel sheet. These materials enable good stabilization of the door and are compatible with the materials typically used in the region of the edge seal.

In an alternative preferred embodiment, the frame element comprises polymers. Polymeric frame elements have an advantageously low weight.

The invention further includes a method for producing an insulating glass unit according to the invention for a refrigeration unit comprising the steps:

Providing a first pane and a second pane,

Providing a spacer frame at least comprising two first hollow-profile polymeric spacers and two second polymeric hollow-profile spacers, Mounting the first pane and the second pane on the spacer frame via a primary sealant, wherein an inner interpane space and an outer interpane space are created, Filling the outer interpane space with a secondary sealant, wherein a transparent primary sealant and a transparent secondary sealant are applied at least along the two first sides.

Preferably, the method is carried out in the order indicated above.

The invention further includes the use of the insulating glass unit according to the invention as a door in a refrigerator display case or in a freezer display case.

Figure 2:
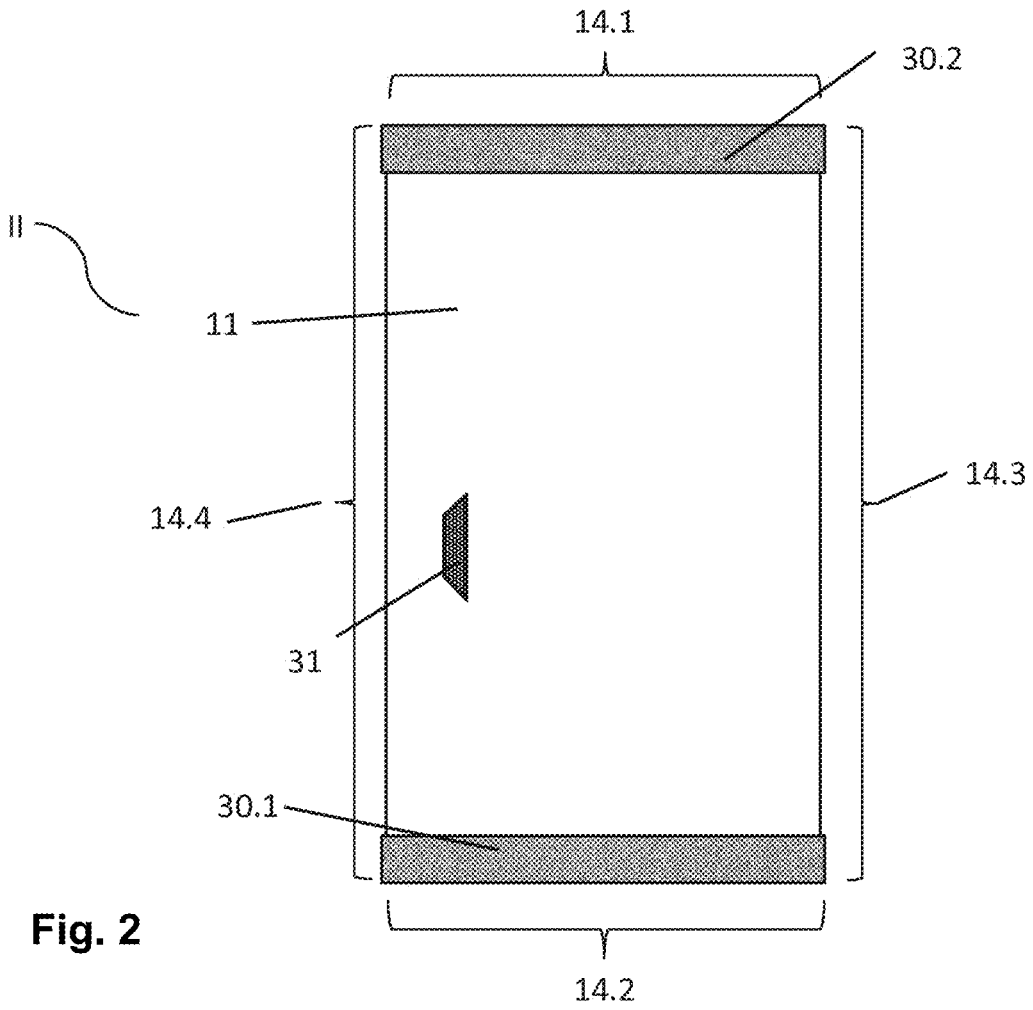
Figure 3:
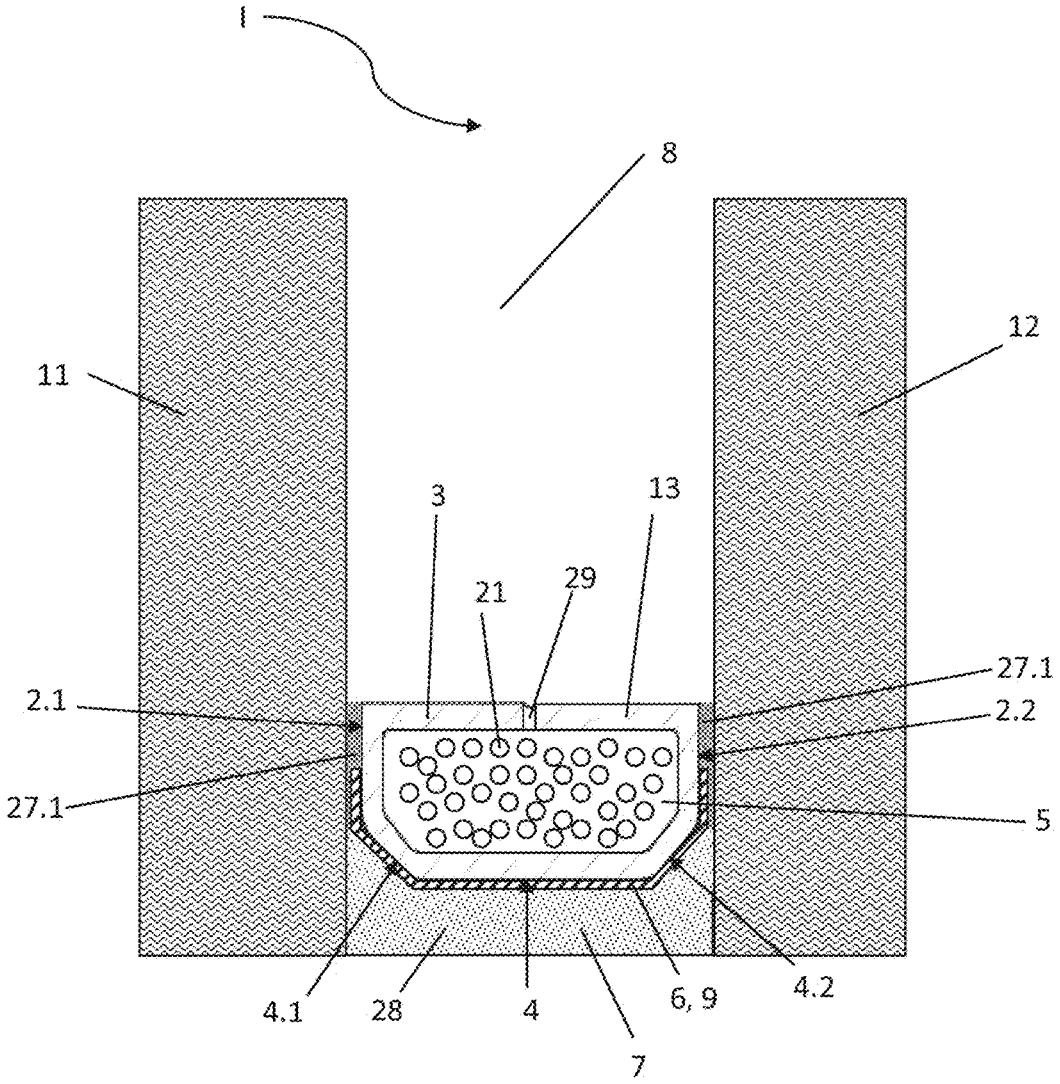
Figure 4:
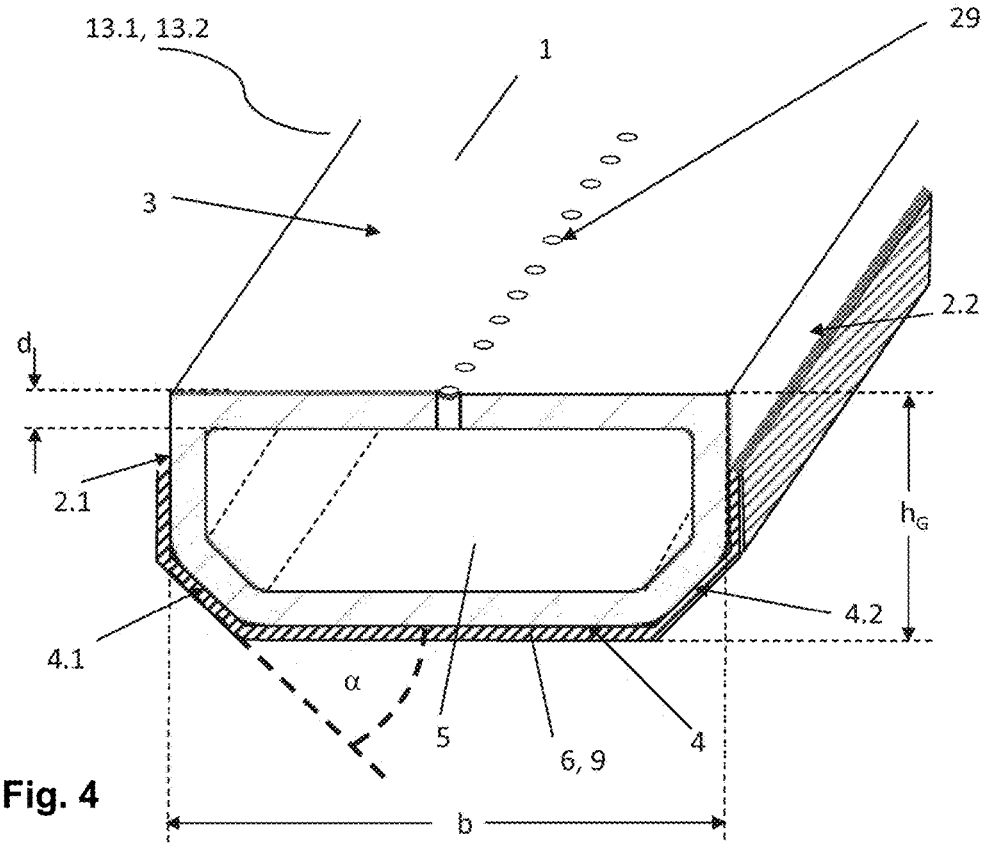
Figure 5:
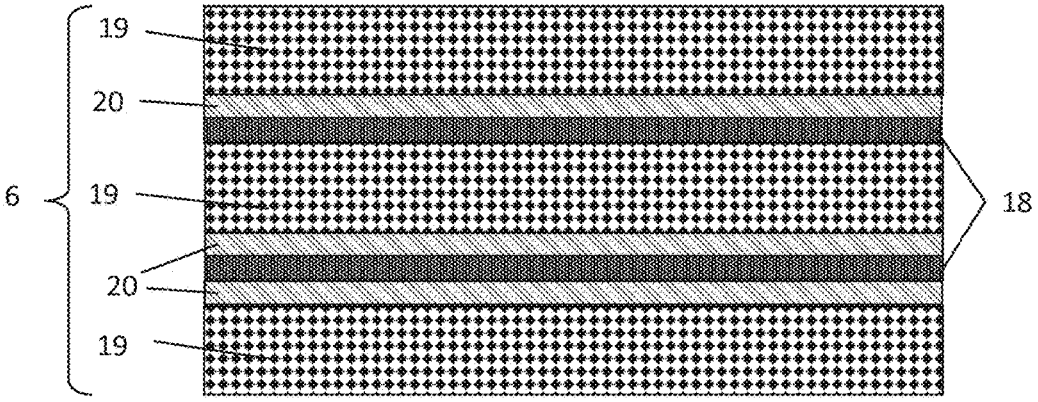
Figure 6:
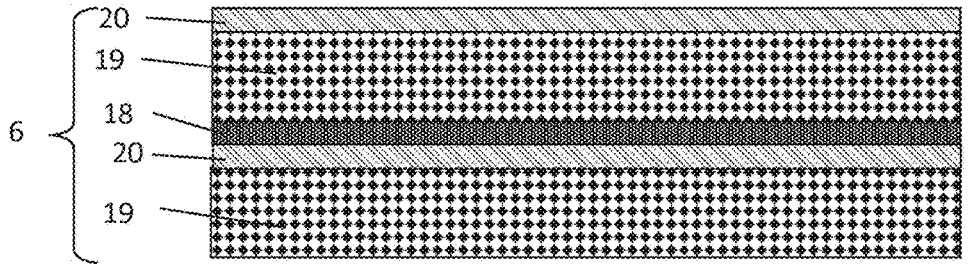
Figure 7:
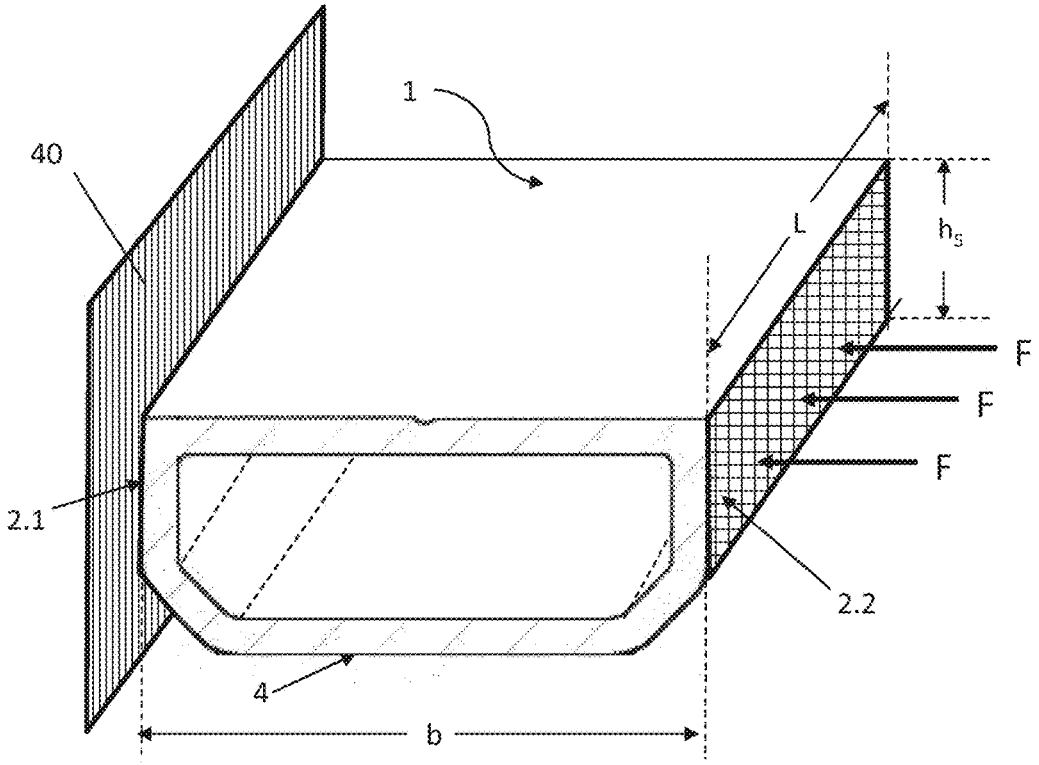

The invention is explained in detail in the following with reference to drawings. The drawings are purely schematic representations and are not true to scale. They in no way restrict the invention. They depict:

FIG. 1 a cross-section through an insulating glass unit according to the invention through the plane of the spacer frame, FIG. 2 a plan view of a possible embodiment of a door according to the invention for a refrigeration unit, FIG. 3 a cross-section through an insulating glass unit according to the invention in the edge region, FIG. 4 a perspective cross-section through a polymeric hollow-profile spacer for an insulating glass unit according to the invention, FIG. 5 a cross-section through a suitable transparent barrier film, FIG. 6 a cross-section through another suitable transparent barrier film, FIG. 7 a perspective cross-section through a polymeric hollow-profile spacer.

FIG. 1 depicts a schematic cross-section through an insulating glass unit according to the invention through the plane of the spacer frame. The insulating glass unit I has a first pane 11 and a parallel and congruently arranged second pane 12 (seen in FIG. 3). A peripheral spacer frame 10 that delimits an inner interpane space 8 is arranged between the first pane 11 and the second pane 12. The spacer frame 10 comprises four hollow-profile polymeric spacers 13.1, 13.2, 13.3, and 13.4, which are in each case arranged along one of the four sides 14.1, 14.2, 14.3, and 14.4 of the insulating glass unit I. The four polymeric hollow-profile spacers 13.1, 13.2, 13.3, and 13.4 are plugged together at the corners of the insulating glass unit by corner connector 25. Connecting by plug-in connectors has the advantage that it is possible to easily combine different types of hollow-profile spacers with one another in a spacer frame 10. Also, the corner connectors 25 can be implemented such that with filling of one of the four hollow-profile spacers with a desiccant 21, the desiccant 21 is prevented from penetrating into the next hollow-profile spacer. The insulating glass unit I is implemented rectangular and has two opposing first sides 14.1, 14.2 and two opposing second sides 14.3 and 14.4. Two first hollow-profile polymeric spacers 13.1 and 13.2 are mounted along the two first sides 14.1 and 14.2. Two second hollow-profile polymeric spacers 13.3 and 13.4 are arranged along the two second sides. The two first polymeric hollow-profile spacers 13.1 and 13.2 are hollow-profile polymeric spacers according to the prior art with a polymeric main body 1 substantially made of styrene acrylonitrile (SAN) with 35% glass fibers as reinforcement fibers. These reinforcement fibers increase the mechanical stability of the polymeric hollow-profile spacer and have proven themselves as reinforcement fibers for polymeric spacers. The first polymeric hollow-profile spacers 13.1 and 13.2 are provided, on the outer wall, with a gas- and vapor-tight barrier, which seals the inner interpane space. Suitable for this is, for example, a multilayer film comprising three layers made of polyethylene terephthalate (PET) with a thickness in each case of 12 μm and two aluminum layers with a thickness in each case of 150 nm. The aluminum layers are alternatingly arranged with the PET layers. Openings 29 are made in the glazing interior surface 3 of the of the first polymeric hollow-profile spacer, via which openings any moisture present in the inner interpane space 8 can be absorbed by the molecular sieve that is filled as desiccant 21 into the cavity 5 of the first polymeric hollow-profile spacers 13.1 and 13.2. The second polymeric hollow-profile spacers 13.3 and 13.4 comprise a polymeric main body 1, which is made substantially of styrene acrylonitrile (SAN) and includes 0% reinforcement fibers. The absence of the reinforcement fibers results in hollow-profile spacers 13.3 and 13.4, which have lower mechanical stability than those with reinforcement fibers. Surprisingly, the stability of the entire insulating glass unit I is not adversely affected thereby and a stable insulating glass unit I is obtained. The second polymeric hollow-profile spacers 13.3 and 13.4 are implemented transparent and include no filling with desiccant. The filling of the two first polymeric hollow-profile spacers 13.1 and 13.2 suffices to absorb the moisture from the inner interpane space 8. The second polymeric hollow-profile spacers 13.3 and 13.4 include a transparent barrier film 6. The details of a suitable transparent barrier film 6 are depicted, for example, in FIG. 5. A transparent silicone is installed in the outer interpane space 7 as a transparent secondary sealant 28.1. The transparent silicone 28.1 is arranged peripherally such that no material incompatibilities between different secondary sealants occur. This embodiment is also simpler to realize in production than combining different secondary sealants 28. The transparent silicone along the second sides 14.3 and 14.4 in combination with the transparently implemented polymeric hollow-profile spacers 13.3 and 13.4 results in an insulating glass unit I with two sides 14.3 and 14.4, along which an unobstructed view of the items situated behind the insulating glass unit I is possible, even in the edge region. Thus, the insulating glass unit I has a maximal through-vision area. Only along the first sides 14.1 and 14.2 does an edge seal with the first polymeric hollow-profile spacers 13.1, 13.2, in each case, block the view through the edge region of the insulating glass unit I.

FIG. 2 depicts a door II according to the invention for a refrigerator display case. The door II comprises two horizontal frame elements 30.1 and 30.2 and an insulating glass unit I, the structure of which is depicted schematically in cross-section in FIG. 1. The horizontal frame elements 30.1 and 30.2 are arranged along the first sides 14.1 and 14.2 of the insulating glass unit I. The two horizontal frame elements 30.1 and 30.2 obscure the view of the first polymeric hollow-profile spacers 13.1 and 13.2 and the edge seal with primary and secondary sealants. The corner connectors 25 are also hidden by the edge seal. The horizontal frame elements 30.1 and 30.2 are formed from a 0.3-mm-thick stainless steel sheet. The frame elements 30.1 and 30.2 increase the stability of the door II. The horizontal frame element 30.2, is at the top with vertical installation of the door II in a refrigerator display case or at the rear with horizontal installation in a freezer display case. The horizontal stainless steel sheet 30.2 wraps around the first and second panes 11 and 12 and thus protects the edges of the panes against damage. The horizontal frame element 30.1, which, after installation in a refrigerator display case, would be arranged at the bottom or, with installation in a freezer display case, would be arranged in the front, is structured exactly like the upper or rear frame element 30.2. The horizontal frame elements 30.1 and 30.2 are glued to the insulating glass unit I. Securing means, such as, for instance, hinges in the case of installation in a refrigerator display case, can be mounted on the horizontal frame elements 30.1 and 30.2 or rails in the case of use as a sliding door in a freezer display case. A door handle 31 that is glued onto the first pane 11 enables simple opening and closing of the door II. Thanks to the combination of first and second polymeric hollow-profile spacers, the insulating glass unit I is so stable that the forces acting on the insulating glass unit I during opening of the door II do not adversely affect the insulating glass unit I.

FIG. 3 depicts a cross-section of an insulating glass unit I according to the invention in the edge region. The structure of the insulating glass unit I is, in principle, identical along all four sides. There are differences between the first and second polymeric hollow-profile spacers. The figure depicts a hollow-profile spacer filled with desiccant 21, which is arranged only along the first sides, as is depicted in FIG. 1. The description of the figure is generally not based on a particular polymeric hollow-profile spacer. The first pane 11 is connected to the first first side wall 2.1 of the polymeric hollow-profile spacers 13 via a transparent primary sealant 27.1, and the second pane 12 is mounted on the second side wall 2.2 via the transparent primary sealant 27.1. The transparent primary sealant 27.1 contains a transparent cross-linking polyisobutylene. The inner interpane space 8 is situated between the first pane 11 and the second pane 12 and is delimited by the glazing interior wall 3 of the spacer 13. The cavity 5 is, in the case of the first polymeric hollow-profile spacers 13.1 and 13.2, filled with a desiccant 21, for example, molecular sieve. The cavity 5 is connected to the inner interpane space 8 via openings in the glazing interior wall 29. A gas exchange occurs between the cavity 5 and the inner interpane space 8 through the openings 29, with the desiccant 21 absorbing the humidity from the inner interpane space 8. The first pane 11 and the second pane 12 protrude beyond the side walls 2.1 and 2.2 such that an outer interpane space 7 is created, which is situated between the first pane 11 and the second pane 12 and is delimited by the outer wall of the hollow-profile spacer 4. The outer interpane space 7 is filled with a transparent secondary sealant 28.1. The transparent secondary sealant 28.1 is, for example, a silicone. Silicones absorb the forces acting on the edge seal particularly well and thus contribute to high stability of the insulating glass unit I. The first pane 11 and the second pane 12 are made of soda lime glass with, in each case, a thickness of 3 mm.

FIG. 4 depicts a cross-section of a polymeric hollow-profile spacer 13.1, 13.2 suitable for an insulating glass unit I according to the invention. The polymeric hollow-profile spacer 13 comprises a polymeric main body with a first side wall 2.1, a side wall 2.2 running parallel thereto, a glazing interior wall 3, and an outer wall 4. The glazing interior wall 3 runs perpendicular to the side walls 2.1 and 2.2 and connects the two side walls. The outer wall 4 is opposite the glazing interior wall 3 and connects the two side walls 2.1 and 2.2. The outer wall 4 runs substantially perpendicular to the side walls 2.1 and 2.2. The sections of the outer wall 4.1 and 4.2 next to side walls 2.1 and 2.2 are, however, inclined at an angle of approx. 45° relative to the outer wall 4 in the direction of the side walls 2.1 and 2.2. The angled geometry improves the stability of the hollow-profile spacer 13 and enables better bonding with a barrier film 6. The wall thickness d of the hollow profile is 1 mm. The hollow profile 1 has, for example, a total height $h_G$ of 6.5 mm and a width b of 16 mm. The outer wall 4, the glazing interior wall 3, and the two side walls 2.1 and 2.2 enclose the cavity 5. The cavity 5 can accommodate a desiccant 21. The polymeric main body 1 contains styrene acrylonitrile (SAN) and, additionally, in the case of the first polymeric hollow-profile spacer, approx. 35 wt.-% glass fibers. A gas- and vapor-tight barrier film 6, which improves the tightness of the spacer 13, is mounted on the outer wall 4 and approx. half of the side walls 2.1 and 2.2. The barrier film 6 can, for example, be secured on the polymeric main body 1 with a polyurethane hot melt adhesive. Alternatively to a barrier film 6, a barrier coating 9 can also be applied. This can be applied directly on the polymeric main body, for example, in a vacuum coating process.

FIG. 5 depicts a cross-section through a transparent barrier film 6 that is suitable to be mounted on a transparent first polymeric hollow-profile spacer 13.1, 13.2. The transparent barrier film 6 is a multilayer film composed of polymeric layers 19 and ceramic layers 20. The polymeric layers consist substantially of 12-μm-thick polyethylene films, and the ceramic layers consist of a 40-nm-thick $SiO_x$ layer. Two polymeric layers 19 are arranged alternatingly with two ceramic layers 20. The alternating arrangement has the advantage that defects in one of the ceramic layers 20 can be compensated by the other layers. In all, three ceramic layers 20 and three polymeric layers 19 are part of the barrier film. Two of the ceramic layers 20 are directly connected via an adhesive layer 18, for example, a 3-μm-thick layer of polyurethane adhesive. By means of this arrangement, all ceramic layers 20 are protected by polymeric layers 19 against mechanical damage from the outside. The transparent barrier film 6 depicted can be produced particularly easily by bonding three polyethylene films, each of which has been coated with a $SiO_x$ layer, via two adhesive layers 18.

FIG. 6 depicts a cross-section through another embodiment of a transparent barrier film 6 that is suitable to be mounted on a transparent first polymeric hollow-profile spacer 13.1, 13.2. The transparent barrier film 6 is a multilayer film with two polymeric layers 19, substantially consisting of polyethylene terephthalate (PET) and two ceramic layers 20, consisting in each case of 30-nm-thick silicon oxide ($SiO_x$) layers. The production of the barrier film 6 can advantageously be done by bonding two PET films coated with $SiO_x$. The adhesive layer 18 is, for example, a 3-μm-thick polyurethane adhesive layer. Preferably, such a barrier 6 with an outward positioned ceramic layer 20 is glued on the hollow-profile spacers such that the polymeric layer 19 faces the hollow-profile spacers and the ceramic layer 20 faces the external environment or the secondary sealant. In this arrangement, the ceramic layer can serve as an adhesion promoter since the adhesion of the customary secondary sealant to a ceramic layer is improved compared with the adhesion to a polymeric layer.

Measurement of Compressive Strength

FIG. 7 depicts a perspective cross-section of a polymeric main body 1 and essential parameters for measurement of the compressive strength of a polymeric hollow-profile spacer. Additionally sketched in are the height of the side wall $h_S$, the length L of a piece of the hollow-profile spacer and the direction of the force F, which acts during the measurement of the compressive strength. The compressive strength describes the stability of the polymeric hollow-profile spacer in the transverse direction. For the measurement of the compressive strength, a polymeric main body 1 is arranged with the first side wall 2.1 on an immovable pressing surface 40. This can be in the orientation depicted in FIG. 6, or the polymeric main body 1 can be placed with the first side wall 2.1 on the pressing surface 40 such that the arrangement depicted in FIG. 6 is rotated counterclockwise by 90°. For the measurement, a piece of polymeric main body 1 of the length L is selected. In the example depicted, the sections 4.1 and 4.2 of the outer wall 4 next to the side walls are angled. Accordingly, the area with which the polymeric main body 1 is in contact with the pressing surface 40 is defined by the length L and the height $h_S$ of a side wall 2. The area $L \times h_S$ on the second side wall 2.2 is characterized by a fine checkered pattern. In the measurement of the compressive strength, the polymeric main body 1 to be measured is clamped and then pressed together at a defined test speed by exertion of a force F on the entire area $L \times h_S$ of the second side wall. The maximum force $F_{max}$ that can be exerted on the polymeric main body 1 before the polymeric main body 1 breaks or collapses is measured. In a graphic plot of the force F exerted against the deformation during the measurement, the force F rises continuously up to a point $F_{max}$, from which the curve suddenly drops. The measurement is terminated at this point.

EXAMPLE

A door according to the invention is equipped with four polymeric hollow-profile spacers, as depicted in FIGS. 1 and 2. The door is rectangular, and the first and second panes are in each case 80 cm×180 cm in size. A transparent butyl was used as a primary sealant, and a transparent silicone was used as a secondary sealant. The two first polymeric hollow-profile spacers are filled with molecular sieve; whereas the second polymeric hollow-profile spacers contain no desiccant. The inner interpane space was filled with a noble gas, in this case argon.

The polymeric main bodies of the first and second hollow-profile spacers have the following dimensions:

Wall thickness d=1 mm; width b=16 mm; total height $h_G$=6.5 mm; height of the side walls $h_S$=4.5 mm The polymeric main bodies of the first polymeric hollow-profile spacers are made substantially of styrene acrylonitrile (SAN) with a glass fiber content of approx. 35%. The polymeric main bodies of the second polymeric hollow-profile spacers are made substantially of styrene acrylonitrile (SAN) and and have a reinforcement fiber content of 0%.

The compressive strength of the polymeric bodies of the first and the second polymeric hollow-profile spacers was measured as described above and the following values were obtained for measurements on pieces of the length L=10 cm at a test speed in each case of 2 mm/min:

| | $F_{max}$/L |
|---|---|
| Main body SAN with 35% glass fibers | 410 N/cm |
| Main body SAN | 295 N/cm |

The compressive strength $F_{max}$/L of the second polymeric hollow-profile spacers is, accordingly, lower by approx. 28% than that of the first polymeric hollow-profile spacers. The influence of the barrier layer or barrier film applied on the main body on the compressive strength values is negligible.

Comparative Example

A door with four polymeric hollow-profile spacers, which include in each case a main body with SAN and 35% glass fiber content, was installed otherwise analogously to the door of the Example. In this case, the compressive strengths of all polymeric hollow-profile spacers are as high as those of the first polymeric hollow-profile spacers in the Example.

Comparison: Example Versus Comparative Example

The two doors were each installed in a refrigerator display case with an internal temperature of −18° C. and and an external temperature of 20° C. The doors were automatically opened and closed again 10000 times on a test bench. After closing, the doors were kept closed for at least 90 seconds so that the temperature in the interior of the refrigerator display case did not heat up excessively during the test.

Then, the insulating glass units of the example door and of the comparative example door were examined. The external appearance of both doors was undamaged. The edge seal was intact and the panes were not fogged up from the inner interpane space. In addition, a dewpoint analysis was performed, as described in DIN EN 1279. Both doors reached a dewpoint of below −60° C., which corresponds to the requirements for such an insulating glazing per DIN EN 1279. In addition, the argon content was determined by gas chromatography. It was, in both cases, approx. 90% which is in compliance with the requirements for a gas-filled insulating glass unit. The sealing and stability of the edge seal of the Example and the Comparative Example is, accordingly, excellent for both. Accordingly, the insulating glass unit with second polymeric hollow-profile spacers without reinforcement fibers has equally great stability as the embodiment according to the prior art with reinforcement fibers in all hollow-profile spaces.

LIST OF REFERENCE CHARACTERS

I insulating glass unit
II door for a refrigeration unit
1 polymeric main body
2 side walls
2.1 first side wall
2.2 second side wall
3 glazing interior wall
4 outer wall
4.1, 4.2 the sections of the outer wall nearest the side walls
5 cavity
6 transparent barrier film
7 outer interpane space
8 inner interpane space
9 barrier coating
10 peripheral spacer frame
11 first pane
12 second pane
13 polymeric hollow-profile spacer
13.1, 13.2 hollow-profile spacers along the first sides 14.1 and 14.2
13.3, 13.4 hollow-profile spacers along the second sides 14.3 and 14.4
14.1, 14.2 two opposing first sides of the insulating glass unit I
14.3, 14.4 two opposing second sides of the insulating glass unit I
18 adhesive layer
19 polymeric layer of the transparent barrier film
20 ceramic layer of the transparent barrier film
21 desiccant
25 corner connector
27 primary sealant
27.1 transparent primary sealant
28 secondary sealant
28.1 transparent secondary sealant
29 openings in the glazing interior wall
30.1, 30.2 horizontal frame elements
31 door handle
40 pressing surface
b width of a hollow-profile spacer
d wall thickness of a hollow-profile spacer
$h_G$ total height of a hollow-profile spacer
$h_S$ height of a side wall of a hollow-profile spacer
L length of a piece of hollow-profile spacer
F force acting in the direction of arrow

The invention claimed is:

1. An insulating glass unit for a refrigeration unit, comprising:

a first pane;

a second pane spaced at a distance from the first pane;

a peripheral spacer frame arranged between the first pane and the second pane; and an inner interpane space, the inner interpane space delimited by the peripheral spacer frame, the first pane and the second pane, wherein the peripheral spacer frame comprises four hollow-profile polymeric spacers, each of the four hollow-profile polymeric spacers secured between the first pane and the second pane along one of four sides of the insulating glass unit via a primary sealant, first two of the four hollow-profile polymeric spacers arranged along two opposing first sides of the insulating glass unit, and second two of the four hollow-profile polymeric spacers arranged along two opposing second sides of the insulating glass unit, the first two of the four hollow-profile polymeric spacers include 5% to 50% reinforcement fibers, the second two of the four hollow-profile polymeric spacers include 0% to 0.5% reinforcement fibers, the second two hollow-profile polymeric spacers include on their outer wall a gas-tight and vapor-tight transparent barrier, wherein the transparent barrier is in the form of a transparent barrier film or a transparent barrier coating, and the transparent barrier film is a multilayer film, the multilayer film comprising at least one polymeric layer and at least one ceramic layer.

2. The insulating glass unit according to claim 1, wherein the second two of the four hollow-profile polymeric spacers are implemented transparent.

3. The insulating glass unit according to claim 1, wherein the hollow-profile polymeric spacers include one polymeric main body, the polymeric main body comprising:

a first side wall;

a second side wall arranged parallel to the first side wall;

a glazing interior wall arranged perpendicular to the first and second side walls, wherein the glazing interior wall connects the first and second side walls to one another;

an outer wall, the outer wall arranged substantially parallel to the glazing interior wall, wherein the outer wall connects the first and second side walls to one another; and a cavity, the cavity enclosed by the first and second side walls, the glazing interior wall, and the outer wall, wherein the cavity delimited by the first two of the four hollow-profile polymeric spacers contains a desiccant and the cavity delimited by the second two of the four hollow-profile polymeric spacers contains no desiccant.

4. The insulating glass unit according to claim 1, wherein the first two hollow-profile polymeric spacers include, as reinforcement fibers, 15% to 40% glass fibers.

5. The insulating glass unit according to claim 1, wherein the first two hollow-profile polymeric spacers include, as reinforcement fibers, 20% to 35% glass fibers.

6. The insulating glass unit according to claim 1, wherein the compressive strength of the second two hollow-profile polymeric spacers is lower by 20% to 40% than that of the first two hollow-profile polymeric spacers.

7. The insulating glass unit for a refrigeration unit according to claim 1, wherein the first two hollow-profile polymeric spacers and the second two hollow-profile polymeric spacers are secured on the first pane and the second pane via a transparent primary sealant, and wherein the outer interpane space facing the external surroundings is filled with a transparent secondary sealant.

8. The insulating glass unit according to claim 1, wherein the multilayer film includes one polymeric layer and two ceramic layers, the two ceramic layers arranged alternatingly with the one polymeric layer.

9. A door for a refrigeration unit, comprising:

i) an insulating glass unit comprising:

a first pane;

a second pane spaced at a distance from the first pane;

a peripheral spacer frame arranged between the first pane and the second pane; and an inner interpane space, the inner interpane space delimited by the peripheral spacer frame, the first pane and the second pane, wherein the peripheral spacer frame comprises four hollow-profile polymeric spacers, each of the four hollow-profile polymeric spacers secured between the first pane and the second pane along one of four sides of the insulating glass unit via a primary sealant, first two of the four hollow-profile polymeric spacers arranged along two opposing first sides of the insulating glass unit, and second two of the four hollow-profile polymeric spacers arranged along two opposing second sides of the insulating glass unit, the first two of the four hollow-profile polymeric spacers include 5% to 50% reinforcement fibers, and the second two of the four hollow-profile polymeric spacers include 0% to 0.5% reinforcement fibers; and ii) two horizontal frame elements, wherein the horizontal frame elements are arranged along the first sides of the insulating glass unit such that the first two hollow-profile polymeric spacers are concealed, the second two hollow-profile polymeric spacers are implemented transparent, the second two hollow-profile polymeric spacers are secured via a transparent primary sealant, and a transparent secondary sealant is arranged along the second sides of the insulating glass unit in the outer interpane space.

10. A method for producing an insulating glass unit for a refrigeration unit, the insulating glass unit comprising:

a first pane;

a second pane spaced at a distance from the first pane;

a peripheral spacer frame arranged between the first pane and the second pane; and an inner interpane space, the inner interpane space delimited by the peripheral spacer frame, the first pane and the second pane, wherein the peripheral spacer frame comprises four hollow-profile polymeric spacers, each of the four hollow-profile polymeric spacers secured between the first pane and the second pane along one of four sides of the insulating glass unit via a primary sealant, first two of the four hollow-profile polymeric spacers arranged along two opposing first sides of the insulating glass unit, and second two of the four hollow-profile polymeric spacers arranged along two opposing second sides of the insulating glass unit, the first two of the four hollow-profile polymeric spacers include 5% to 50% reinforcement fibers, the second two of the four hollow-profile polymeric spacers include 0% to 0.5% reinforcement fibers, the second two hollow-profile polymeric spacers include on their outer wall a gas-tight and vapor-tight transparent barrier, wherein the transparent barrier is in the form of a transparent barrier film or a transparent barrier coating, and the transparent barrier film is a multilayer film, the multilayer film comprising at least one polymeric layer and at least one ceramic layer, the method comprising:

mounting the first pane and the second pane on the peripheral spacer frame via the primary sealant, wherein the inner interpane space and an outer interpane space are created; and filling the outer interpane space with a secondary sealant, wherein a transparent primary sealant and a transparent secondary sealant are applied along the two opposing first sides.

* * * * *